US009689233B2

(12) United States Patent
Nguyen et al.

(10) Patent No.: US 9,689,233 B2
(45) Date of Patent: Jun. 27, 2017

(54) PLATFORM TO SERVICE A BLOWOUT PREVENTER

(71) Applicant: Cameron International Corporation, Houston, TX (US)

(72) Inventors: Hoan Phuoc Nguyen, Houston, TX (US); Vallie Hodges, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/320,456

(22) Filed: Jun. 30, 2014

(65) Prior Publication Data

US 2015/0376907 A1 Dec. 31, 2015

(51) Int. Cl.

| | |
|---|---|
| ***E21B 41/00*** | (2006.01) |
| ***E04G 1/36*** | (2006.01) |
| ***E21B 33/06*** | (2006.01) |
| *E04G 3/00* | (2006.01) |

(52) U.S. Cl.

CPC ..... *E21B 41/00* (2013.01); *E04G 1/36* (2013.01); *E21B 33/06* (2013.01); *E04G 3/00* (2013.01)

(58) Field of Classification Search

CPC . E21B 41/00; E21B 33/06; E04G 1/36; E04G 1/362; E04G 3/24; E04G 3/243

See application file for complete search history.

(56) References Cited

U.S. PATENT DOCUMENTS 335,164 A * 2/1886 Vitalis ..... 182/113
1,893,489 A * 1/1933 Barycz ..... E21B 33/06 166/94.1
2,066,984 A * 1/1937 Lamb ..... 182/113
3,215,454 A * 11/1965 Hayes ..... E21B 17/01 166/340
3,330,339 A * 7/1967 Johnson ..... E21B 7/12 166/298
3,330,340 A * 7/1967 Hayes ..... E21B 17/012 166/340
3,426,843 A * 2/1969 Visser ..... E21B 17/01 166/352
4,401,184 A 8/1983 Sherry
4,407,392 A * 10/1983 Lazzari ..... 182/128
5,533,592 A * 7/1996 Lamoureux ..... 182/128
5,954,305 A * 9/1999 Calabro ..... 248/219.4
(Continued)

FOREIGN PATENT DOCUMENTS

CN 202417382 U 9/2012

OTHER PUBLICATIONS

International Search Report and Written Opinion dated Sep. 16, 2015 for PCT Application No. PCT/US2015/036378 filed on Jun. 18, 2015.

*Primary Examiner* — Colleen M Chavchavadze
(74) *Attorney, Agent, or Firm* — Chamberlain Hrdlicka

(57) ABSTRACT

A platform and a system including the platform are used for a ram blowout preventer including a bonnet and/or one or more components adjacent the ram blowout preventer. The platform includes a frame with a deck supported within the frame, and a support structure coupled to the frame to support the platform on the bonnet of the ram blowout preventer. The platform may further include a connector to removably couple the platform to the bonnet of the ram blowout preventer.

17 Claims, 12 Drawing Sheets

(56) References Cited

U.S. PATENT DOCUMENTS

| | | | | |
|---|---|---|---|---|
| 6,158,516 | A * | 12/2000 | Smith | E21B 3/045 166/385 |
| 6,223,855 | B1 * | 5/2001 | Lindner | 182/131 |
| 6,267,201 | B1 | 7/2001 | Cunniffe | |
| 6,494,268 | B1 * | 12/2002 | Ljungdahl | E21B 19/002 166/339 |
| 6,681,894 | B1 * | 1/2004 | Fanguy | 182/113 |
| 6,779,614 | B2 * | 8/2004 | Oser | 175/85 |
| 6,830,127 | B2 * | 12/2004 | Johnson | 182/113 |
| 6,848,539 | B2 * | 2/2005 | Lee | E04G 1/36 182/113 |
| 7,073,592 | B2 * | 7/2006 | Polsky | E21B 19/22 166/360 |
| 7,931,122 | B2 * | 4/2011 | Grandy | 182/128 |
| 8,235,126 | B2 * | 8/2012 | Bradley | 166/379 |
| 8,302,736 | B1 * | 11/2012 | Olivier | 182/187 |
| 2004/0011592 | A1 | 1/2004 | Lee | |
| 2009/0095569 | A1 * | 4/2009 | Cooper et al. | 182/187 |

* cited by examiner

PLATFORM TO SERVICE A BLOWOUT PREVENTER

BACKGROUND

Blowout preventers (BOPs) are used extensively throughout the oil and gas industry. Typical blowout preventers are used as a large specialized valve or similar mechanical device that seal, control, and monitor oil and gas wells. The two categories of blowout preventers that are most prevalent are ram blowout preventers and annular blowout preventers. Blowout preventer stacks frequently utilize both types, typically with at least one annular blowout preventer stacked above several ram blowout preventers. The ram units in ram blowout preventers allow for both the shearing of the drill pipe and the sealing of the blowout preventer. Typically, a blowout preventer stack may be secured to a wellhead and may provide a safe means for sealing the well in the event of a system failure.

In a typical blowout preventer, a ram bonnet assembly may be bolted to the main body using a number of high tensile bolts or studs. These bolts are required to hold the bonnet in position to enable the sealing arrangements to work effectively. Typically an elastomeric sealing element is used between the ram bonnet and the main body. There are several configurations, but essentially they are all directed to preventing a leakage bypass between the mating faces of the ram bonnet and the main body.

During normal operation, the blowout preventers may be subject to pressures up to 20,000 psi, or even higher. To be able to operate against and to contain fluids at such pressures, blowout preventers are becoming larger and stronger. Blowout preventer stacks, including related devices, 30 feet or more in height are increasingly common.

As noted above, ram-type blowout preventers that close around drill pipe are designed and constructed for use with drill pipe of specified diameter. A blowout preventer stack including rams for one size of pipe may be used with pipe of a different size by changing the pipe engaging rams or parts of the rams. Also, the ram operating mechanisms in a blowout preventer are comparatively complex and require inspection and servicing before the blowout preventer is put into service at a wellhead. Such activities, when performed in a large modern blowout preventer stack, may require the presence of personnel at locations well above the bottom of the stack at heights which can be hazardous. The use of safety harnesses by stack service personnel is known, but has been found to restrict movement of personnel in the performance of their tasks.

BRIEF DESCRIPTION OF THE DRAWINGS

For a detailed description of the preferred embodiments of the present disclosure, reference will now be made to the accompanying drawings in which.

DETAILED DESCRIPTION

Figure 1:
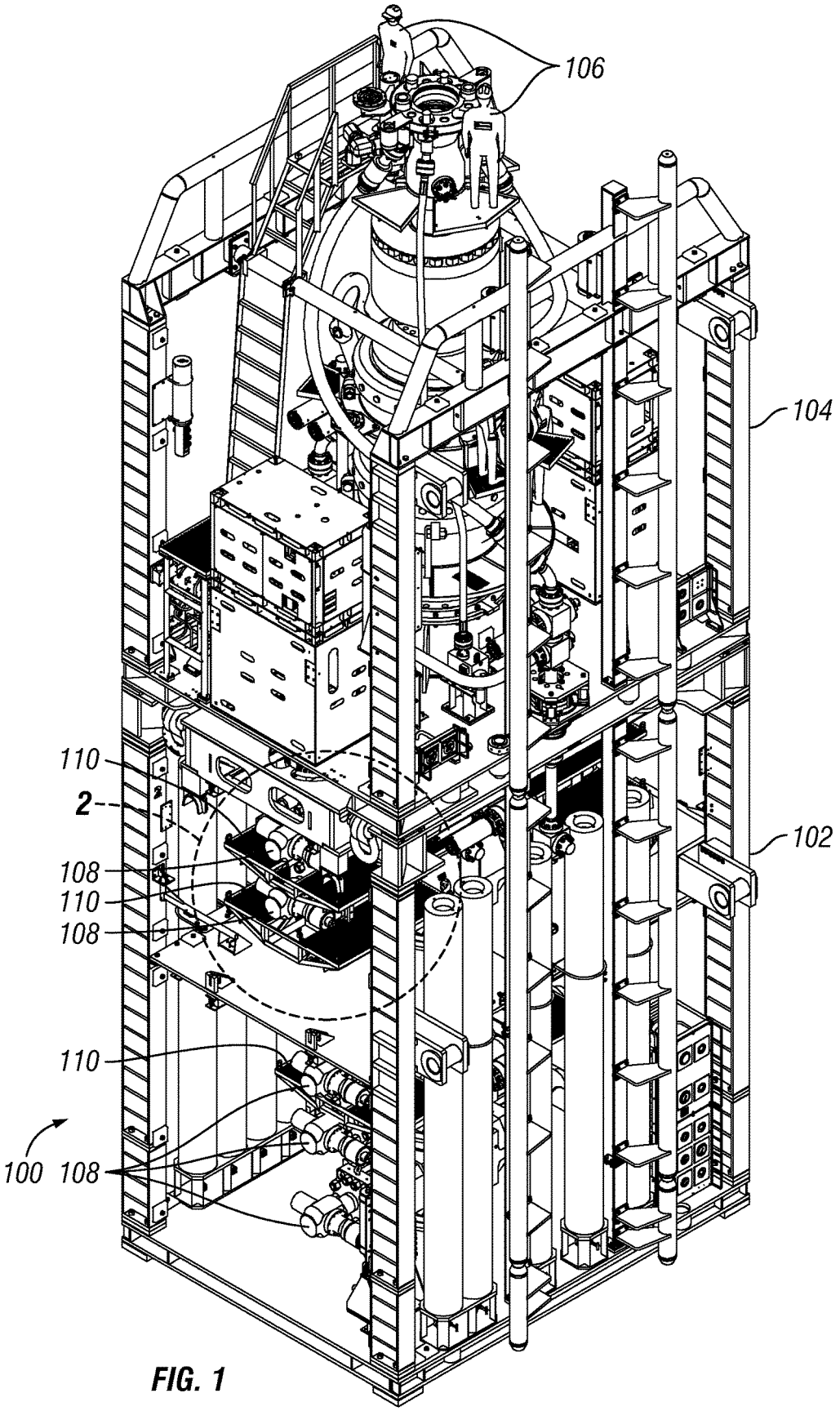
FIG. 1 shows a perspective view of a system of a subsea stack including a blowout preventer stack and a lower marine riser package in accordance with one or more embodiments of the present disclosure.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Accordingly, disclosed herein are a platform for servicing a blowout preventer within a blowout preventer stack and a system incorporating the platform. The platform includes a frame with a deck supported by or within the frame, and a support structure coupled to the frame. The support structure supports the platform on a bonnet of a ram blowout preventer within the blowout preventer stack. A connector is then used to couple, such as removably couple, the platform to the bonnet of the ram blowout preventer. The platform may then be used to assist in servicing and maintenance of one or more components within or adjacent to the ram blowout preventer.

Referring now to FIG. 1, a perspective view of a system 100 of a subsea stack including a blowout preventer stack 102 and a lower marine riser package (LMRP) 104 in accordance with one or more embodiments of the present disclosure are shown. The system 100 is shown as positioned above sea level for maintenance and service before being positioned subsea at the sea floor and mounted to a wellhead to assist with sealing, controlling, and/or otherwise monitoring a well. Accordingly, one or more workers 106 are shown as positioned within the system 100 for service and maintenance purposes with respect to the system 100.

Figure 2:
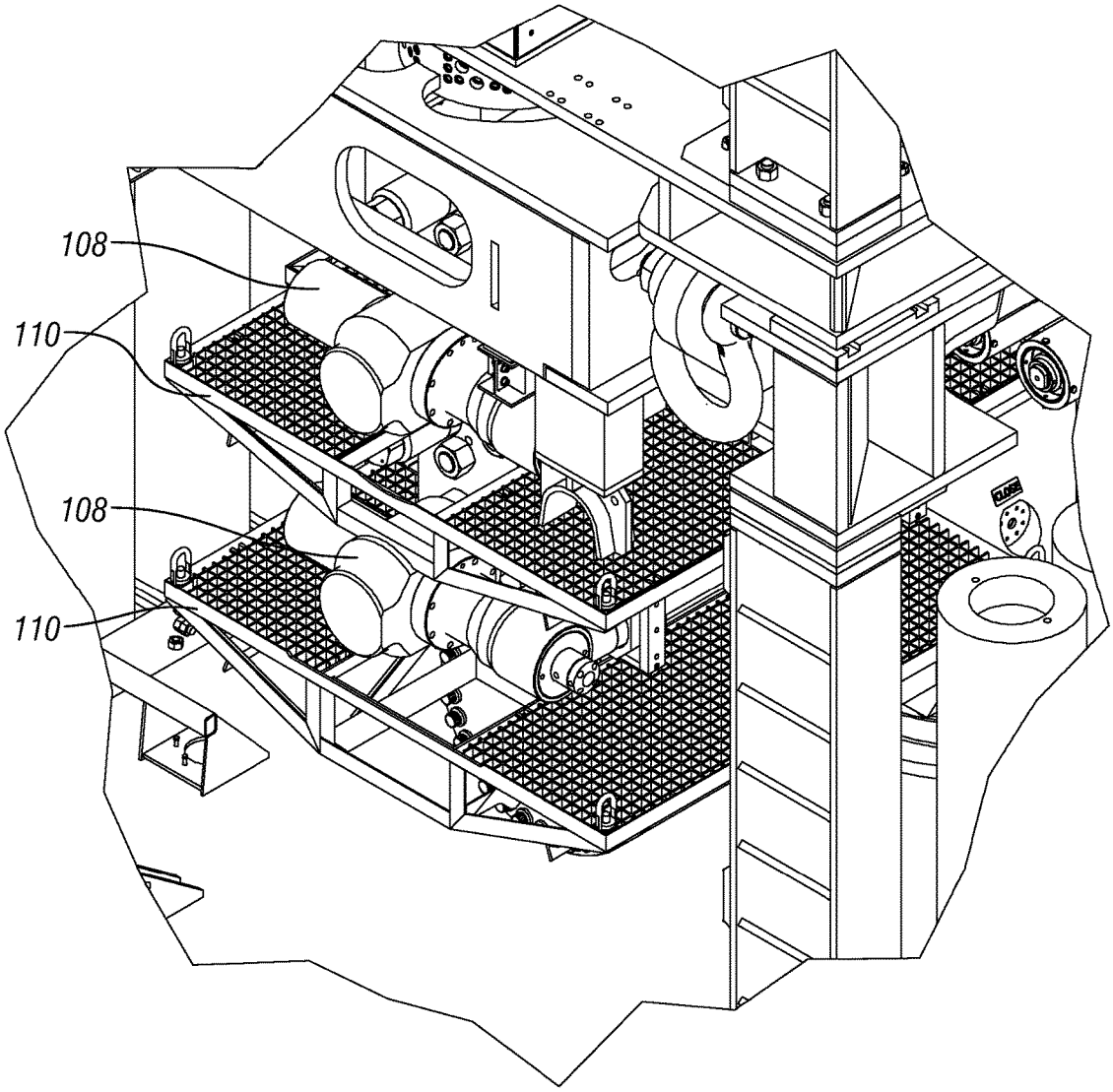
FIG. 2 shows a detailed view of platforms in use with ram blowout preventers of a blowout preventer stack in accordance with one or more embodiments of the present disclosure.

As shown, multiple ladders, steps, and/or other similar assemblies or structures may be used to access one or more different components within the system 100. However, one or more components within the system 100 may not be accessible, such as due to size or locational constraints from the components within the system 100. For example, the blowout preventer stack 102 may include one or more blowout preventers, such as one or more ram blowout preventers 108, in which space and vertical room may be limited to prevent availability and access to the ram blowout preventers 108. Accordingly, one or more platforms 110 in accordance with the present disclosure may be used to facilitate access to the ram blowout preventers 108, such as when service or maintenance may be required for the ram blowout preventers 108. FIG. 2 shows a detailed view of the platforms 110 in use with the ram blowout preventers 108 of the blowout preventer stack 102 in accordance with one or more embodiments of the present disclosure.

Figure 3:
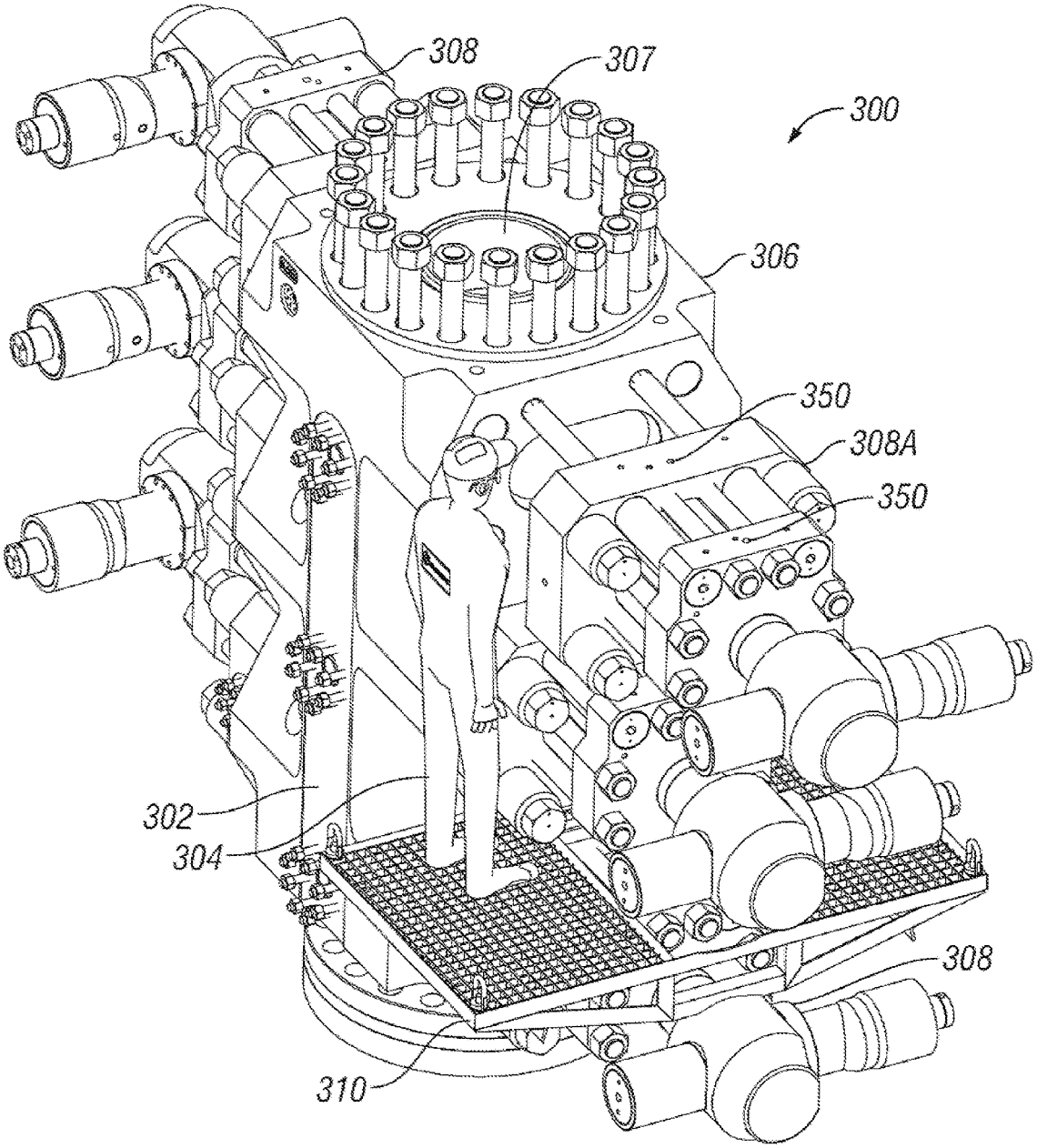
FIG. 3 shows a perspective view of a system including one or more ram blowout preventers and a platform to facilitate access to the ram blowout preventers in accordance with one or more embodiments of the present disclosure.
Figure 4A:
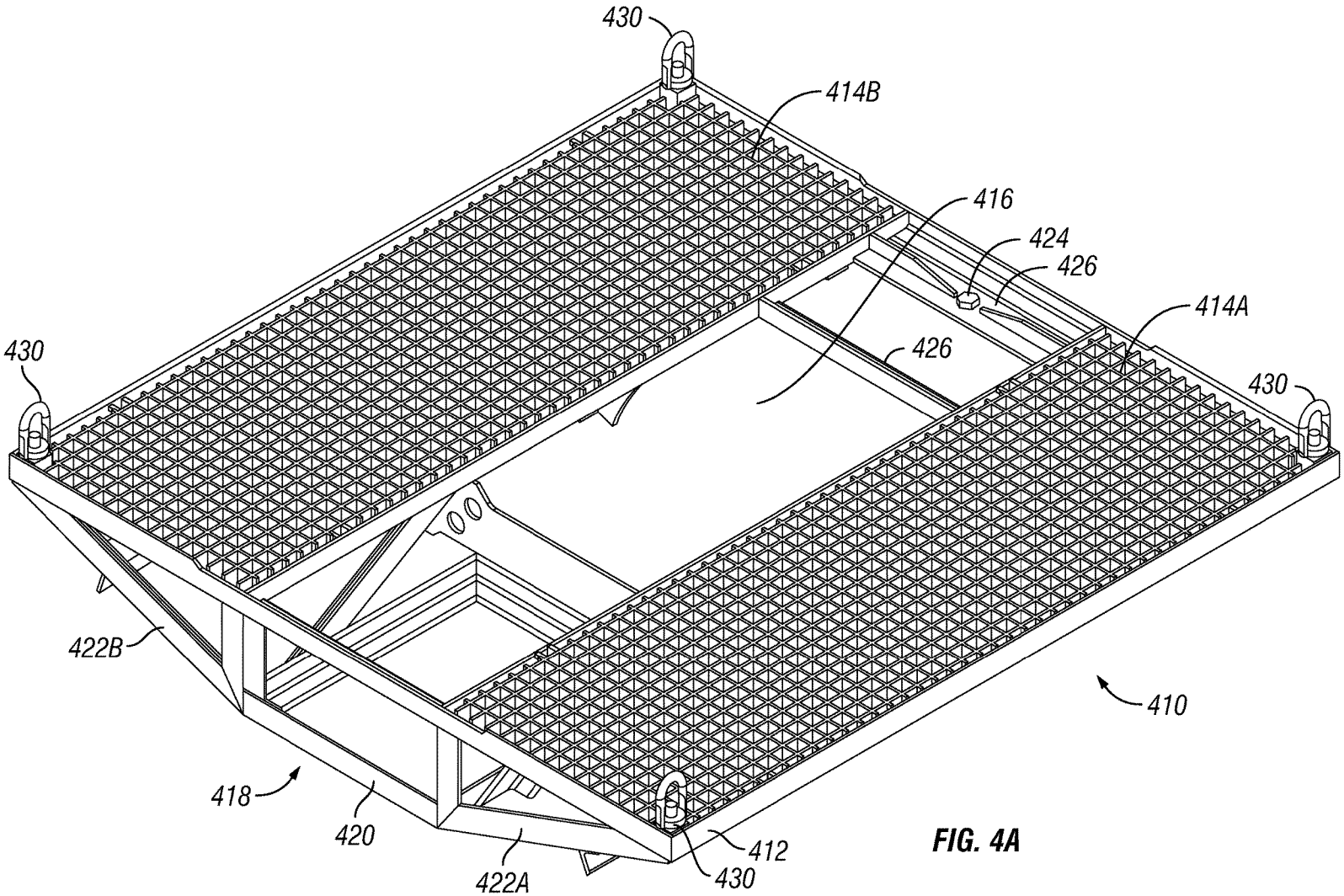
FIGS. 4A-4E show multiple views of a platform for use with a ram blowout preventer in accordance with one or more embodiments of the present disclosure are shown.
Figure 4B:
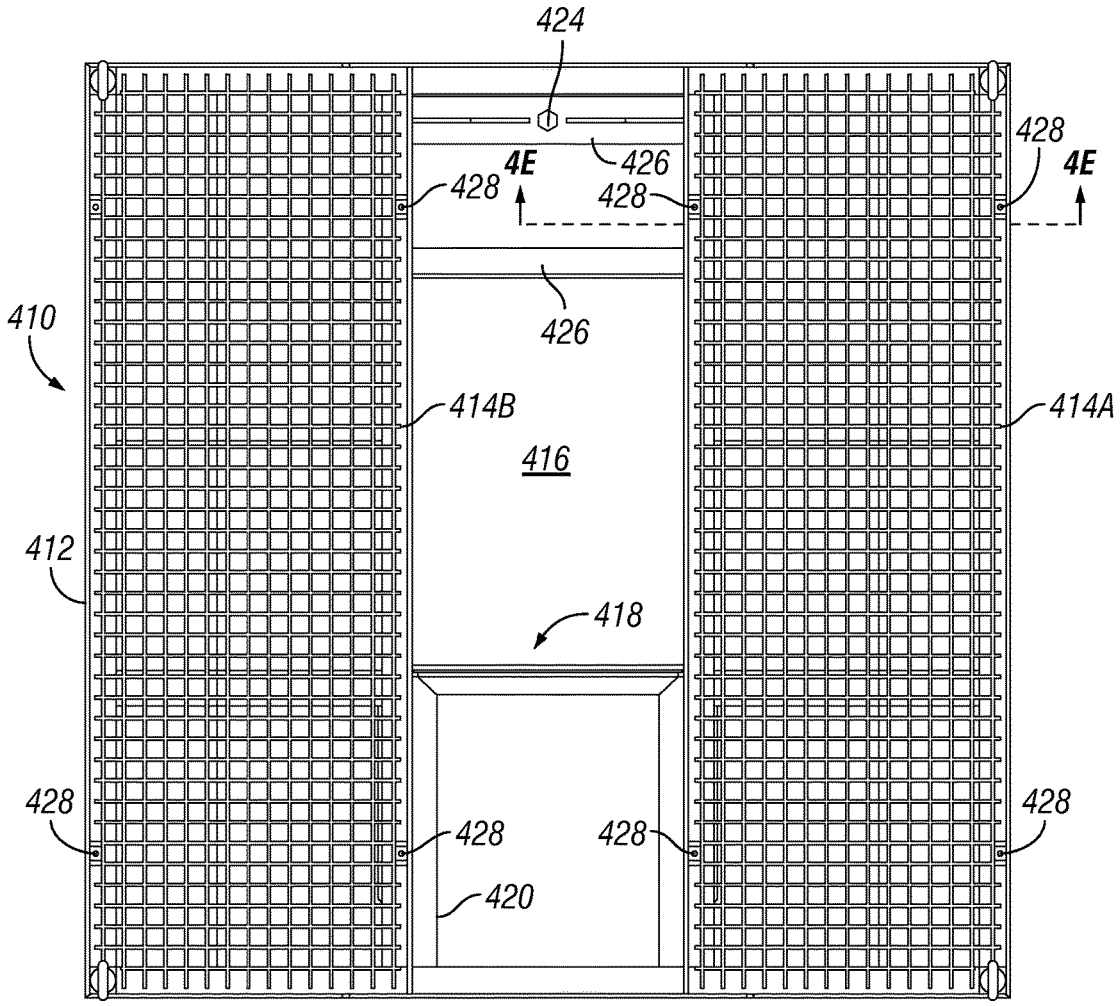
Figure 4C:
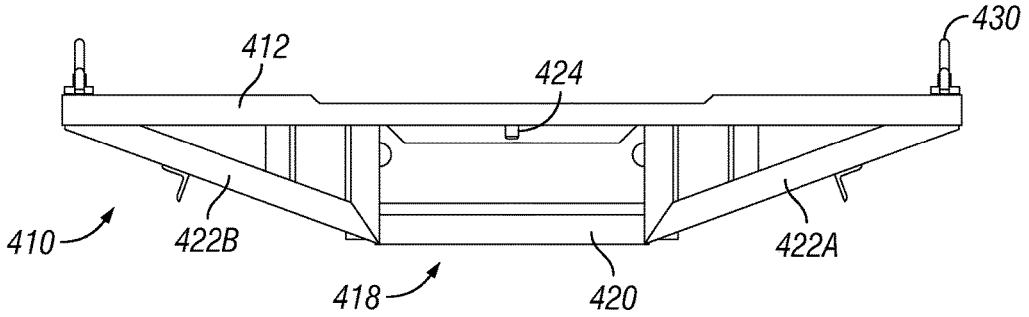
Figure 4D:
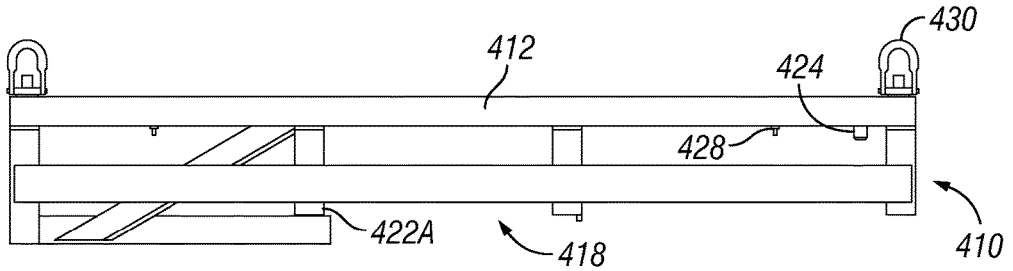
Figure 4E:
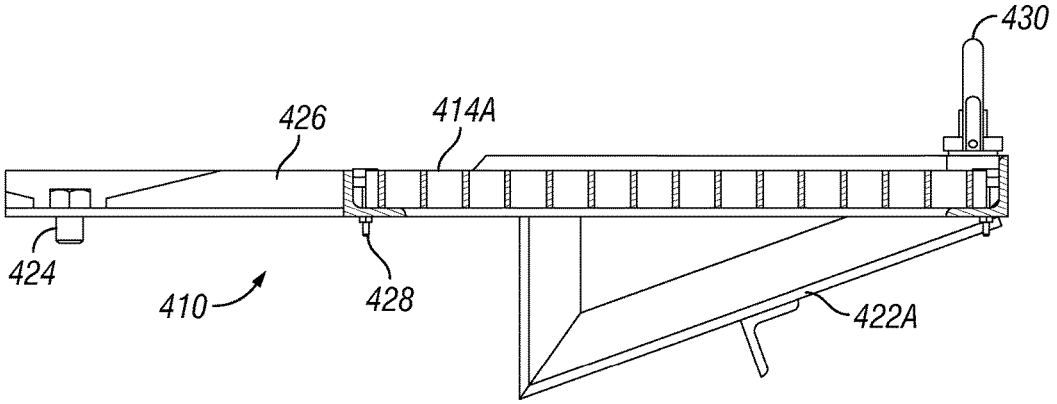
Figure 5A:
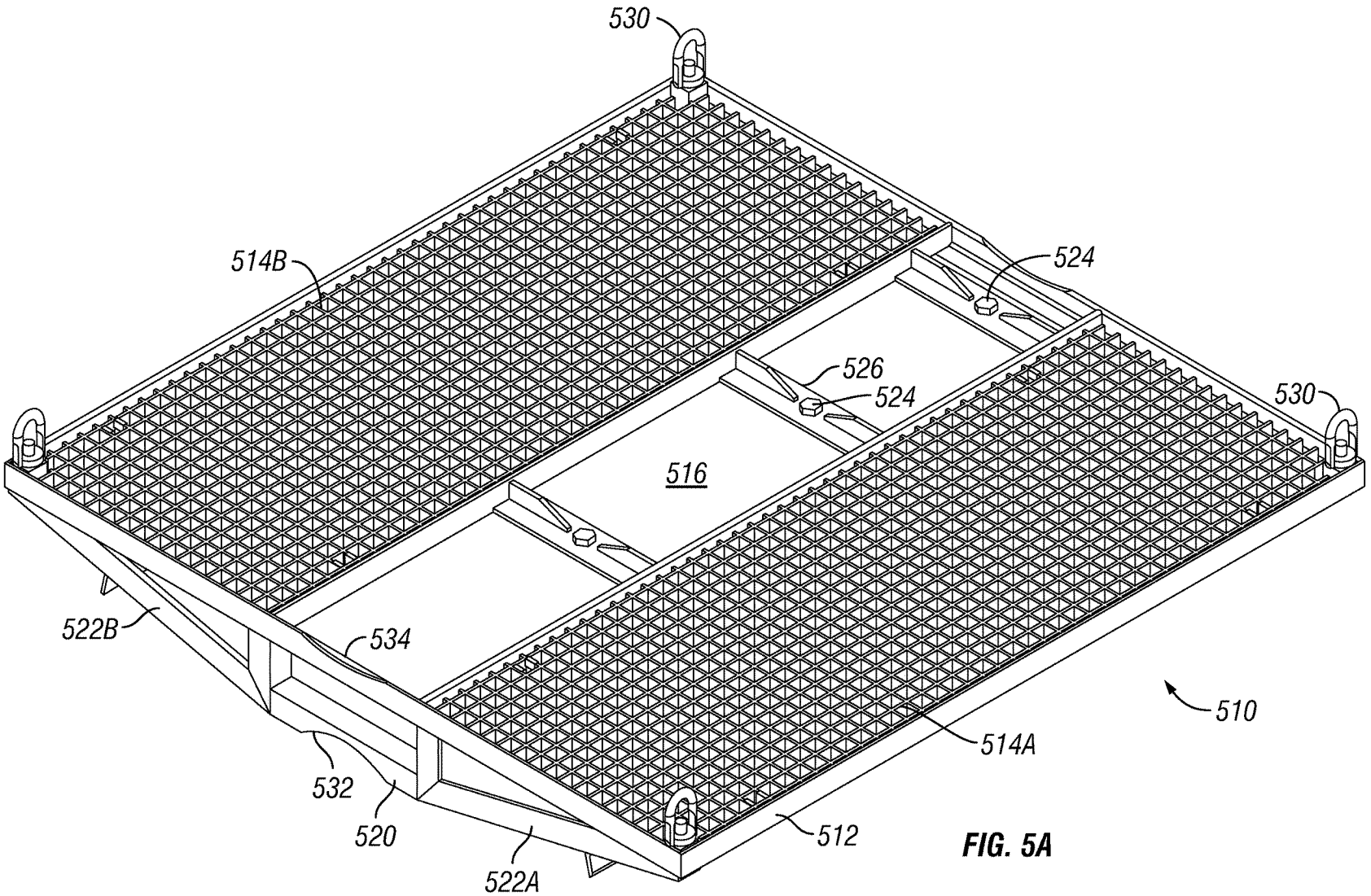
FIGS. 5A-5E show multiple views of a platform for use with a ram blowout preventer in accordance with one or more embodiments of the present disclosure are shown.
Figure 5B:
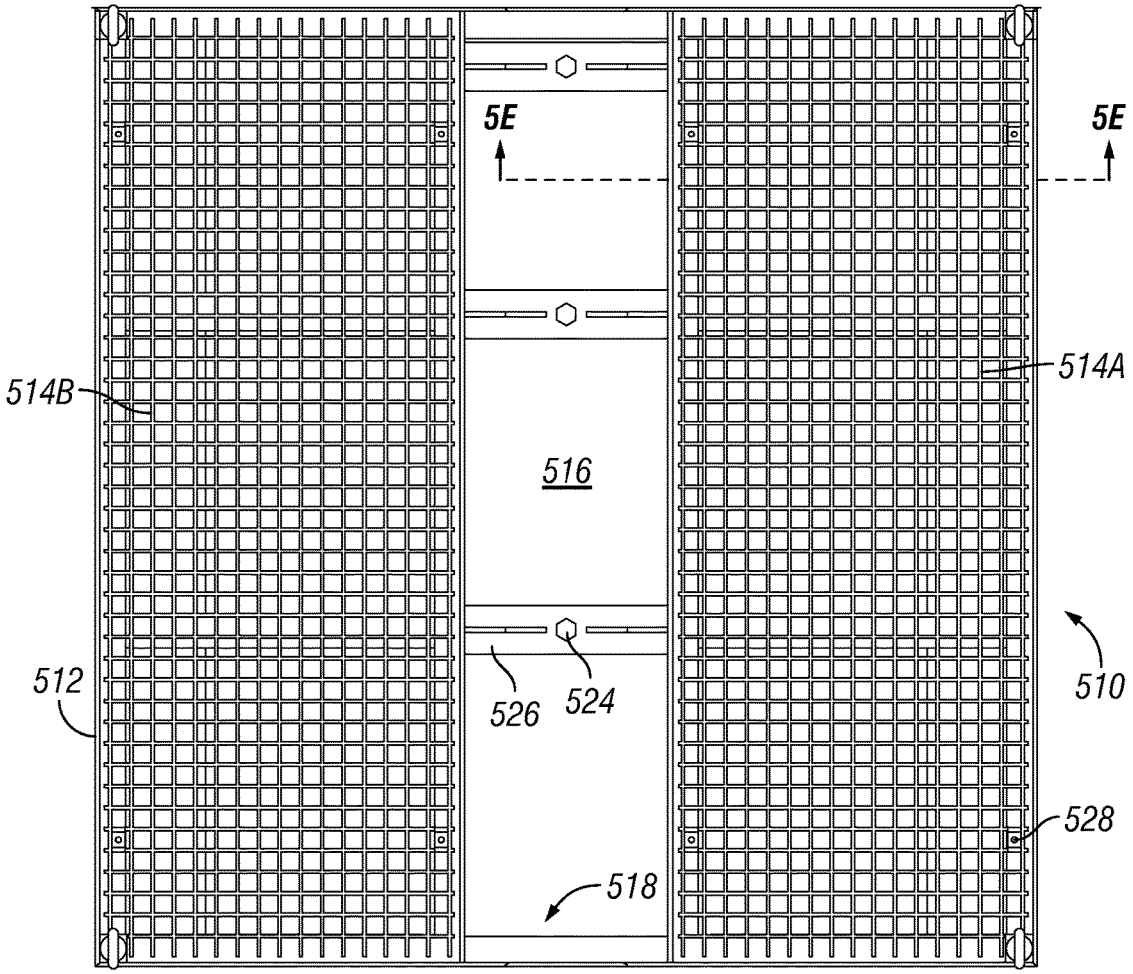
Figure 5C:
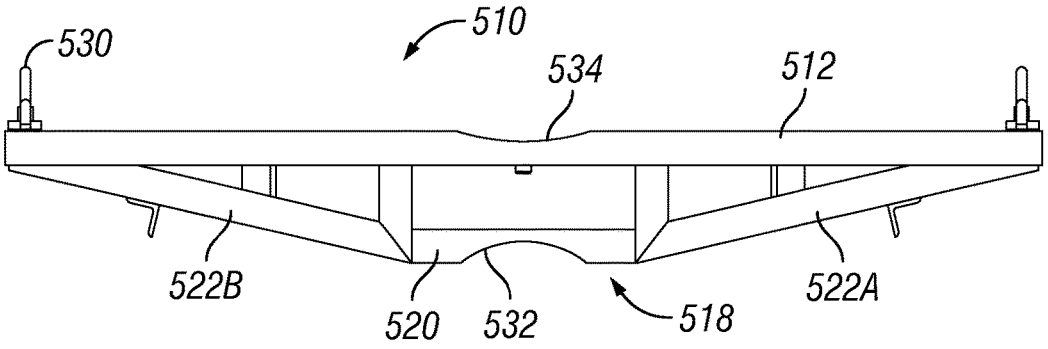
Figure 5D:
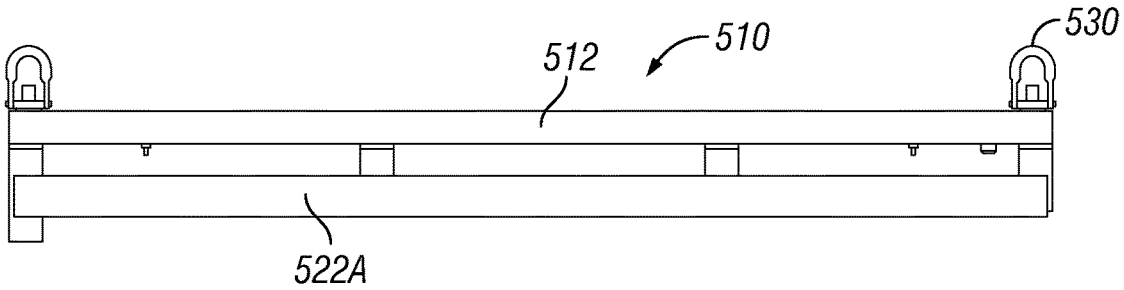
Figure 5E:
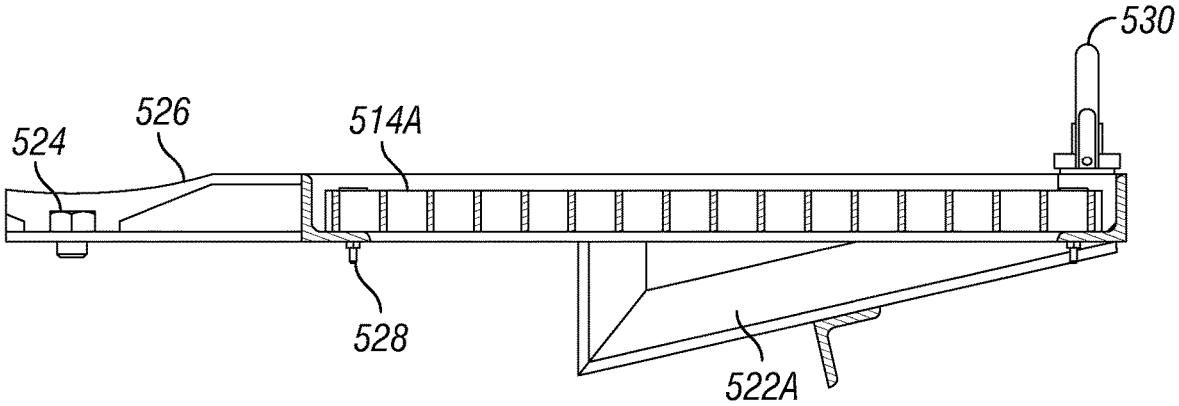
Figure 6A:
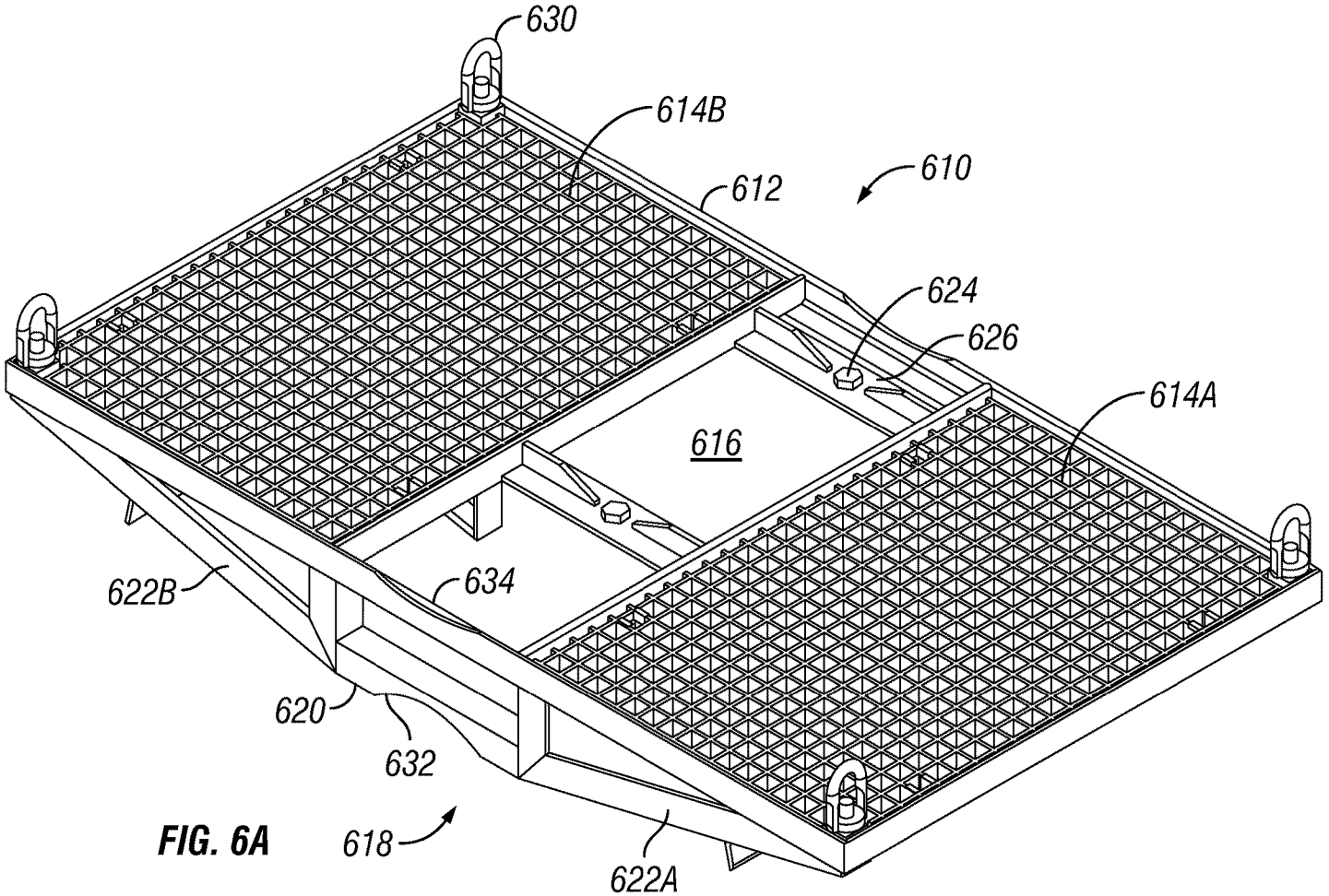
FIGS. 6A-6E show multiple views of a platform for use with a ram blowout preventer in accordance with one or more embodiments of the present disclosure are shown.
Figure 6B:
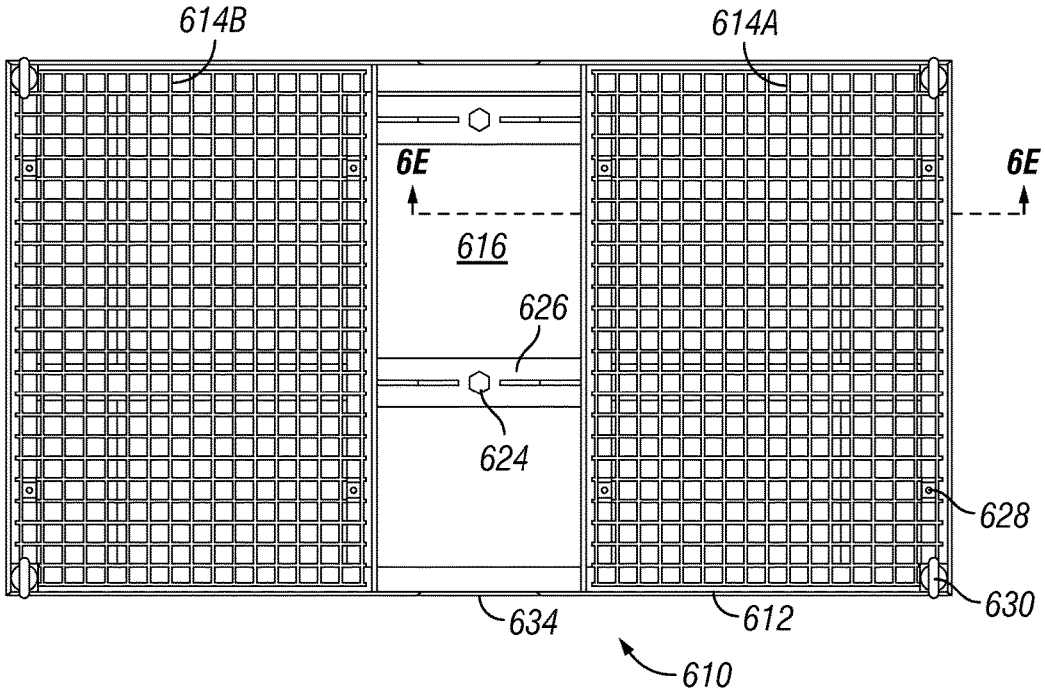
Figure 6C:
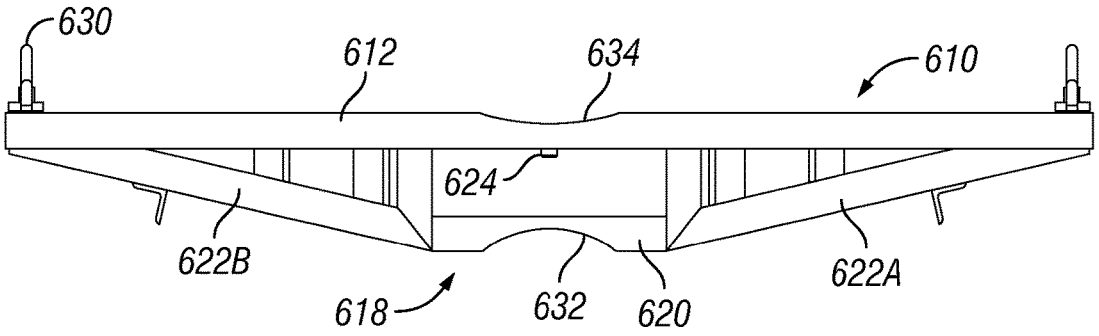
Figure 6D:
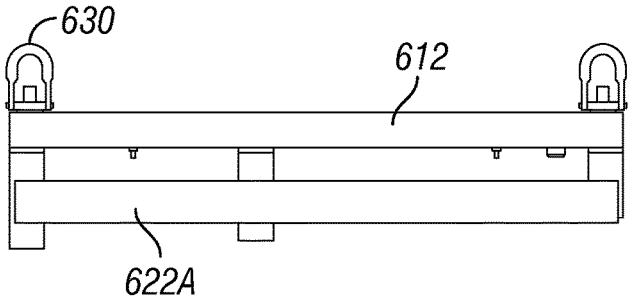
Figure 6E:
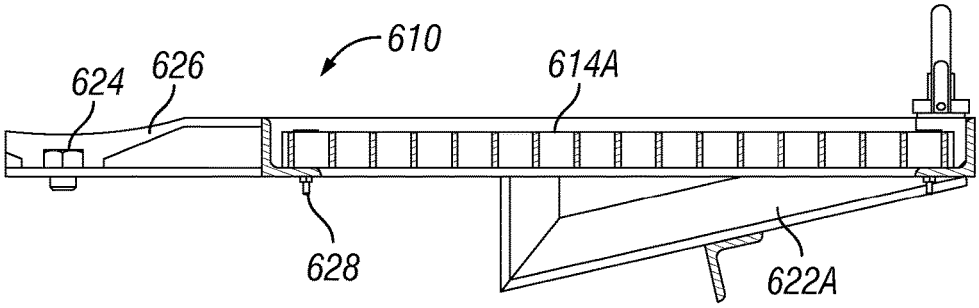

Referring now to FIG. 3, a perspective view of a system 300 including one or more ram blowout preventers 302 and a platform 310 to facilitate access to the ram blowout preventers 302 in accordance with one or more embodiments of the present disclosure are shown. As such, a worker 304 may use the platform 310 for servicing the ram blowout preventers 302, as shown. A ram blowout preventer 302 may include a housing 306 or main body, in which one or more bonnets 308 may be coupled and secured to the housing 306 of the ram blowout preventer 302. A bonnet 308 may be used to house and secure an actuator assembly, such as a hydraulic actuator assembly, to the housing 306, in which the actuator assembly may be used to support and move a ram within the housing 306.

In FIG. 3, though the present disclosure is not so limited, a triple blowout preventer is shown, as the ram blowout preventer 302 includes three pairs or sets of bonnets 308 coupled and secured to the housing 306. However, those having ordinary skill in the art will appreciate that a ram blowout preventer may include only one set of bonnets, or even only one bonnet, without departing from the scope of the present disclosure. Accordingly, an example for the ram blowout preventer 302 may include axially stacked sets of opposed rams housed and secured within the bonnets 308, such as opposed blind shear rams or blades that may be used to sever a tubular string and seal off the wellbore, opposed blind rams for sealing off the wellbore when no tubular string is present, and/or opposed pipe rams for engaging a tubular string and sealing the annulus around the tubular string. Accordingly, the set of rams may be equipped with sealing members that engage to prohibit flow through the annulus around tubular string and/or through a main bore 307 of the housing 306 of the ram blowout preventer 302 when the rams are closed, thereby enabling each set of rams to function as a sealing mechanism.

The opposed rams may move into and out of the main bore 307 of the housing 306 such that each set of rams may be actuated and transitioned between an open position and a closed position. In the open position, the rams are radially withdrawn from the main bore 307 and do not interfere with a tubular string or other hardware that may extend through the main bore 307. However, in the closed position, the rams may radially extend into the main bore 307 to close off and seal the main bore 307 or the annulus around a present tubular string. As such, each set of rams may be actuated and transitioned between the open and closed positions by the actuator assemblies, in which each actuator assembly may hydraulically move a piston within a cylinder to move a drive rod coupled to the rams. Accordingly, though the present disclosure is not so limited, examples of ram blowout preventers that the platform 310 may be used with include a Standard TL BOP, a Tandem Booster TL BOP, a 5 k Super Shear BOP, each available from Cameron International Corporation of Houston, Tex.

Referring still to FIG. 3, the platform 310 is shown as in use with to service the ram blowout preventer 302, in which a bonnet 308A is shown as unbolted and unsecured from the housing 306 for service and maintenance of the ram blowout preventer 302. Service and maintenance of the ram blowout preventer 302 may include numerous activities, such as replacing seals within the ram blowout preventer 302 to replacing the function of the ram blowout preventer 302 by replacing the types of rams included within the ram blowout preventer 302. Accordingly, the platform 304 may be configured to be supported on and/or removably coupled to a bonnet 308 extending from a side of the housing 306 of the ram blowout preventer 302, thereby facilitating access to the ram blowout preventer 302 for the worker 304.

Referring now to FIGS. 4A-4E, multiple views of a platform 410 for servicing a ram blowout preventer in accordance with one or more embodiments of the present disclosure are shown. As discussed above, the platform 410 may be configured to be supported on and/or removably coupled to a bonnet of a ram blowout preventer. The platform 410 may include a frame 412, such as a rectangular frame as shown, in which one or more decks 414 may be supported within or upon the frame 412. In this embodiment, the frame 412 may support a first deck 414A and a second deck 414B within the frame 412. Further, a gap 416 may be formed and extend, as least partially or between portions of, the first deck 414A and the second deck 414B. Accordingly, the gap 416 may be used to reduce the overall weight of the platform 410, and/or one or more components of the ram blowout preventer may extend through the gap 416 of the platform 410 when positioned upon a bonnet of a ram blowout preventer.

The platform 410 may further include a support structure 418 coupled to the frame 412, such as positioned below the frame 412, in which the support structure 418 may be used to rest upon and support the platform 410 on the bonnet of a ram blowout preventer. The support structure 418 is shown as extending across the width of the frame 412 from one side of the frame 412 to the other side of the frame 412, thereby extending from an outer edge of the first deck 414A to an outer edge of the second deck 414B. Further, the support structure 418 may include a central portion 420 with a first side portion 422A coupled to one side of the central portion 420 and a second side portion 422B coupled to the other (e.g., opposite) side of the central portion 420. In this embodiment, the central portion 420 may be positioned under the gap 416 formed within the frame 412, whereas the first side portion 422A may be positioned under the first deck 414A and the second side portion 422B may be positioned under the second deck 414B. Accordingly, the first side portion 422A may be angled and/or extend from the central portion 420 to the outer edge of the frame 412 below the first deck 414A, and the second side portion 422B may be angled and/or extend from the central portion 420 to the outer edge of the frame 412 below the second deck 414B.

The platform 410 may further include one or more connectors 424 to coupled, such as removably couple, the platform 410 to the bonnet, or some other component, of the ram blowout preventer. For example, in FIGS. 4A-4E, one or more support arms 426 may extend across the gap 416 between the first deck 414A and the second deck 414B. Accordingly, the connector 424, which may be a bolt, screw, or some other type of connector, may be positioned through the support arm 426 to removably couple the frame 412 of the platform 410 to the bonnet of a ram blowout preventer through the support arm 426.

In one or more embodiments, a connector 424 may be used to couple the platform 410 to pre-existing tie-down points formed within a bonnet of a ram blowout preventer. For example, with reference to FIG. 3, one or more tie-down points 350, such as female threaded holes, may be formed centrally along a top surface of the bonnets 308, in which one or more connectors 424 may be used to removably couple the platform 410 to one or more pre-existing tie-down points 350 formed within the bonnets 308 of the ram blowout preventer 302. Further, for ease, one or more of the connectors 424 may be movably secured to the platform 410, such as by tying the connectors 424 to the platform 410 to prevent loss of the connectors 424 when transporting the platform 410.

Referring back to FIGS. 4A-4E, one or more of the decks 414 may include grating, such as to reduce the overall weight of the platform 410. In particular, in one or more embodiments, one or more of the decks 414 may be formed, at least partially, from a lighter weight composite, such as fiberglass resin and/or carbon fiber, and the frame 412 and/or the support structure 418 may be formed, at least partially, from a lighter weight metal, such as aluminum. Further, one or more retainers 428, such as shown in particularly in FIG. 4B, to removably couple the decks 414 to the frame 412.

The platform 410 may further include one or more attachment points 430, such as to support the platform 410 from and to facilitate transportation of the platform 410. For example, with reference to FIGS. 4A and 4B, an attachment point 430 may be positioned at each corner of the rectangular frame 412. In this embodiment, though the present disclosure is not so limited, one or more of the attachment points 430 may include a swivel eye to support the platform 410 therefrom, such as when transporting the platform 410 with a crane or other type of machine.

One having ordinary skill in the art will appreciate that, though not shown, hand rails and/or support rails may be included with a platform in accordance with one or more embodiments of the present disclosure. For example, one or more hand rails may be coupled to the frame of the platform and extend upward from the platform. The hand rails may also be removable from the platform, such as to facilitate transportation of the platform.

One having ordinary skill in the art will appreciate that a platform in accordance with the present disclosure may be sized and adjusted, such as based upon the size and arrangement of components for use with the platform. In one embodiment, if a bonnet of a ram blowout preventer for use with the platform is larger or smaller, then the platform may be adjusted in size to also be larger or smaller, as desired. Further, in another embodiment, if additional or different pre-existing tie-down points are formed within a bonnet of a ram blowout preventer for use with the platform, then the locations of the connectors included with the platform may be adjusted accordingly.

Accordingly, multiple views of another platform 510 for servicing a ram blowout preventer in accordance with one or more embodiments of the present disclosure are shown in FIGS. 5A-5E. Further, multiple views of yet another platform 610 for servicing a ram blowout preventer in accordance with one or more embodiments of the present disclosure are shown in FIGS. 6A-6E. The platform 510 shown in FIGS. 5A-5E and the platform 610 shown in FIGS. 6A-6E may be similar, such as with features and function, to the platform 410 shown in FIGS. 4A-4E. Accordingly, the platforms 410, 510, and 610 may have similar reference numbers. For example, the platform 510 may include a frame 512 that supports a first deck 514A and a second deck 514B with a gap 516 formed therebetween, and the platform 610 may include a frame 612 that supports a first deck 614A and a second deck 614B with a gap 616 formed therebetween.

As the platforms 410, 510, and 610 may be used with bonnets and ram blowout preventers having different sizes, shapes, and dimensions, the platforms 410, 510, and 610 may vary in size, shape, and dimension with respect to each other. For example, the platform 510 may have overall larger and wider decks 514A and 514B and an overall smaller and thinner gap 516 with respect to the platform 410. Further, the platform 610 may overall be shorter in length with respect to the platform 410. Accordingly, the present disclosure is not so limited to only the embodiments shown in the accompanying figures.

Further, in one or more embodiments, a platform may include one or more cutouts and/or shapes formed into the frame and/or the support structure to facilitate securing a platform to a bonnet of a ram blowout preventer. For example, as shown in FIGS. 5A-5E, the support structure 518 may have a cutout 532 formed therein to facilitate a level placement of the platform 510. The cutout 532 may have a shape that complements a shape of the bonnet of the ram blowout preventer. Accordingly, in this embodiment, the cutout 532 may be a rounded cutout. Further, the cutout 532 may be formed more particularly within the central portion 520 of the support structure 518. A cutout 534, such as a rounded cutout, may also be formed within the frame 512, in which the cutout 534 may be formed within the frame 512 in line with, above, and/or adjacent to the central portion 520 of the support structure 518.

Similarly, as shown in FIGS. 6A-6E, the platform 610 may include a cutout 632, such as formed within the support structure 618, to facilitate supporting the platform 610 on the bonnet of a ram blowout preventer, and more particularly may have the cutout 632 rounded and formed within the central portion 620 of the support structure 618. Further, a cutout 634, such as a rounded cutout, may also be formed within the frame 612, in which the cutout 634 may be formed within the frame 612 in line with, above, and/or adjacent to the central portion 620 of the support structure 618.

A platform in accordance with the present disclosure may facilitate service and maintenance of one or more components within or adjacent to a ram blowout preventer. For example, a platform in accordance with the present disclosure may be supported on top of a bonnet of a ram blowout preventer. Accordingly, a worker positioned upon such a platform may be able to service one or more components located above the platform, such as a bonnet or another component of the ram blowout preventer located above the platform, and/or one or more other components adjacent the platform. Further, a platform in accordance with the present disclosure may be lighter in weight and have attachment features to facilitate transportation and movement of the platform.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A platform for a ram blowout preventer comprising a bonnet, comprising:

a frame including a deck supported within the frame;

a support structure coupled to the frame and configured to support the platform on top of the bonnet horizontally mounted to a body of the ram blowout preventer, the support structure comprising a rounded cutout formed therein and configured to engage the top of the bonnet to secure the frame to the bonnet of the ram blowout preventer; and a connector configured to removably couple the frame to the bonnet of the ram blowout preventer.

2. The platform of claim 1, wherein the deck supported within the frame includes a first deck and a second deck with a gap formed between the first deck and the second deck.

3. The platform of claim 2, further comprising a support arm extending across the gap between the first deck and the second deck.

4. The platform of claim 3, wherein the connector is configured to removably couple the platform to the bonnet of the ram blowout preventer through the support arm.

5. The platform of claim 1, wherein the deck comprises a grating, and wherein the grating comprises fiberglass resin.

6. The platform of claim 1, further comprising a retainer to removably couple the deck to the frame.

7. The platform of claim 1, further comprising an attachment point to support and transport the platform, wherein the attachment point comprises a swivel eye.

8. The platform of claim 1, wherein the support structure is positioned below the frame, wherein the support structure extends from one side of the frame to another side of the frame.

9. The platform of claim 8, wherein the support structure comprises a central portion with a first side portion angled and extending from the central portion to the one side of the frame and a second side portion angled and extending from the central portion to the other side of the frame.

10. The platform of claim 1, wherein the connector is configured to removably couple the platform to pre-existing tie-down points formed within the bonnet of the ram blowout preventer.

11. A system, comprising:

a platform configured to be supported on top of a bonnet horizontally mounted to a body of a ram blowout preventer, the platform comprising a frame, a deck supported by the frame, and a rounded cutout formed in the platform and configured to engage the top of the bonnet to secure the platform to the bonnet of the ram blowout preventer.

12. The system of claim 11, wherein the platform further comprises:

a support structure coupled to the frame and configured to support the platform on the bonnet of the ram blowout preventer, wherein the rounded cutout is formed in the support structure; and a connector configured to removably couple the frame to the bonnet of the ram blowout preventer.

13. The system of claim 12, wherein the connector is configured to removably couple the frame to pre-existing tie-down points formed within the bonnet of the ram blowout preventer.

14. The system of claim 12, wherein the deck supported by the frame includes a first deck and a second deck with a gap formed between the first deck and the second deck.

15. The system of claim 14, wherein the support structure comprises a central portion, a first angled side portion, and a second angled side portion, wherein the central portion is positioned below the gap, the first angled portion is positioned below the first deck, and the second angled portion is positioned below the second deck.

16. The system of claim 12, wherein the deck supported by the frame includes a first deck and a second deck with a gap formed between the first deck and the second deck; and further comprising a support arm extending across the gap between the first deck and the second deck.

17. The system of claim 16, wherein the connector is configured to removably couple the platform to the bonnet of the ram blowout preventer through the support arm.

* * * * *